US011940169B2

(12) United States Patent
Longenecker

(10) Patent No.: US 11,940,169 B2
(45) Date of Patent: Mar. 26, 2024

(54) AIR CONDITIONER WITH THERMOSTAT SETPOINT ESTIMATION

(71) Applicant: Haier US Appliance Solutions, Inc., Wilmington, DE (US)

(72) Inventor: Joshua Duane Longenecker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/569,044

(22) Filed: Jan. 5, 2022

(65) Prior Publication Data

US 2023/0213235 A1 Jul. 6, 2023

(51) Int. Cl.

| | |
|---|---|
| ***F24F 11/63*** | (2018.01) |
| ***F24F 11/30*** | (2018.01) |
| ***F24F 11/86*** | (2018.01) |
| *F24F 110/10* | (2018.01) |

(52) U.S. Cl.

CPC ..... *F24F 11/86* (2018.01); *F24F 11/30* (2018.01); *F24F 11/63* (2018.01); *F24F 2110/10* (2018.01)

(58) Field of Classification Search

CPC .. F24F 11/86; F24F 11/30; F24F 11/63; F24F 2110/10

See application file for complete search history.

(56) References Cited

U.S. PATENT DOCUMENTS 6,397,613 B1 * 6/2002 Izawa ..... F25B 41/24 62/149
7,730,731 B1 * 6/2010 Bash ..... F25B 49/025 62/198
10,267,530 B2 4/2019 Ushirosako
2003/0192326 A1 * 10/2003 Masuda ..... B60H 1/3208 62/133
2006/0048531 A1 * 3/2006 Eisenhour ..... F25B 49/022 62/228.3
2012/0260678 A1 * 10/2012 Yoshida ..... F25B 41/35 62/56
2012/0324927 A1 * 12/2012 Suzuki ..... B60H 1/3211 62/126

(Continued)

FOREIGN PATENT DOCUMENTS

JP 2006275460 A 10/2006

OTHER PUBLICATIONS

Proportional control, Wikipedia, https://web.archive.org/web/20210501000000*/https://en.wikipedia.org/wiki/Closed-loop controller, Sep. 16, 2021, accessed Jun. 9, 2023. (Year: 2021).*

(Continued)

*Primary Examiner* — Jonathan Bradford

(74) *Attorney, Agent, or Firm* — Dority & Manning, P.A.

(57) ABSTRACT

Air conditioner units and methods of operating the same are provided. A method of operating an air conditioner unit includes measuring an ambient temperature and estimating a setpoint temperature of the air conditioner unit. The method also includes inputting the measured ambient temperature and the estimated setpoint temperature into a closed-loop control algorithm. The method further includes setting a compressor speed of the variable speed compressor based on the output of the closed-loop control algorithm. An air conditioner unit may include a controller, and the controller may be configured for performing the method.

14 Claims, 5 Drawing Sheets

(56) References Cited

U.S. PATENT DOCUMENTS

| | | | | |
|---|---|---|---|---|
| 2016/0153694 | A1* | 6/2016 | Ko | F25D 17/04 62/186 |
| 2017/0276413 | A1* | 9/2017 | Takeichi | F25B 49/022 |
| 2017/0292728 | A1* | 10/2017 | Ushirosako | F24F 11/86 |
| 2017/0328621 | A1* | 11/2017 | Nagae | F24F 11/89 |
| 2018/0100677 | A1* | 4/2018 | Sekiya | F24F 11/65 |
| 2018/0290519 | A1* | 10/2018 | Son | B60H 1/3222 |
| 2018/0340719 | A1* | 11/2018 | Rona | F25B 5/02 |
| 2020/0018531 | A1* | 1/2020 | Bortoff | G05B 15/02 |
| 2021/0222905 | A1* | 7/2021 | Morioka | F24F 11/65 |
| 2021/0404691 | A1* | 12/2021 | Sakata | F24F 11/86 |

OTHER PUBLICATIONS

Wright, What is a closed loop control system, Whatls-dot-com, 2023, accessed Jun. 9, 2023. (Year: 2023).*

* cited by examiner

AIR CONDITIONER WITH THERMOSTAT SETPOINT ESTIMATION

FIELD OF THE INVENTION

The present subject matter relates generally to air conditioning appliances, and more particularly to air conditioning appliances having closed-loop controls.

BACKGROUND OF THE INVENTION

Air conditioner units or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Some air conditioner units include a variable speed compressor which is capable of operation at any selected speed within a range of possible operating speeds. The optimal speed for such variable speed compressors may be determined based on the ambient temperature, e.g., current temperature in a room or other area to be cooled, and the target temperature or setpoint temperature. For example, the ambient temperature and the setpoint temperature may be input into a closed-loop control algorithm to determine the speed of the compressor. However, some air conditioner units that include a variable speed compressor may be coupled with a thermometer that has limited communication capabilities, e.g., that does not transmit the setpoint temperature to the air conditioner unit. Thus, the air conditioner unit may not be able to operate the variable speed compressor at an optimal speed based on the ambient temperature and the setpoint temperature when the air conditioner unit does not receive the setpoint temperature information from the thermostat.

As a result, further improvements to air conditioners may be advantageous. In particular, it would be useful to provide an air conditioner that is capable of estimating the setpoint temperature when the setpoint temperature data is not received from the thermostat, e.g., because the thermostat lacks such communication capabilities and/or is malfunctioning.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating an air conditioner unit is provided. The air conditioner unit includes a housing that defines an outdoor portion and an indoor portion. An outdoor heat exchanger is disposed in the outdoor portion. An indoor heat exchanger is disposed in the indoor portion. A variable speed compressor is in fluid communication with the outdoor heat exchanger and the indoor heat exchanger to circulate a refrigerant between the outdoor heat exchanger and the indoor heat exchanger. The method includes measuring an ambient temperature and estimating a setpoint temperature of the air conditioner unit. The method also includes inputting the measured ambient temperature and the estimated setpoint temperature into a closed-loop control algorithm. The method further includes setting a compressor speed of the variable speed compressor based on the output of the closed-loop control algorithm.

In another exemplary aspect of the present disclosure, an air conditioner unit is provided. The air conditioner unit includes a housing defining an outdoor portion and an indoor portion. An outdoor heat exchanger is disposed in the outdoor portion. An indoor heat exchanger is disposed in the indoor portion. The air conditioner unit also includes a variable speed compressor in fluid communication with the outdoor heat exchanger and the indoor heat exchanger to circulate a refrigerant between the outdoor heat exchanger and the indoor heat exchanger. The air conditioner unit further includes a controller. The controller is configured for measuring an ambient temperature and estimating a setpoint temperature of the air conditioner unit. The controller is also configured for inputting the measured ambient temperature and the estimated setpoint temperature into a closed-loop control algorithm. The controller is further configured for setting a compressor speed of the variable speed compressor based on the output of the closed-loop control algorithm.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
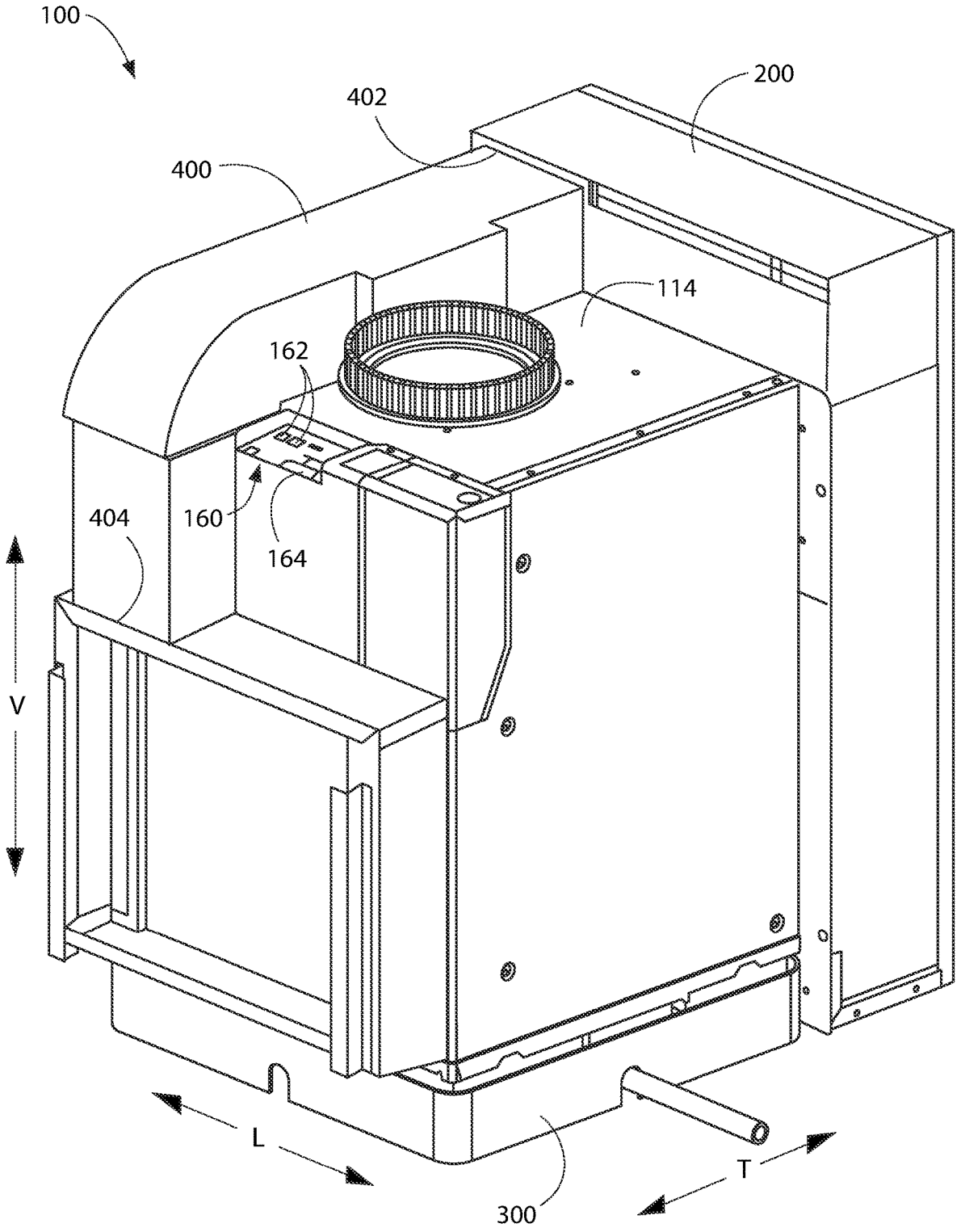
FIG. 1 provides a perspective view of an air conditioner unit according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
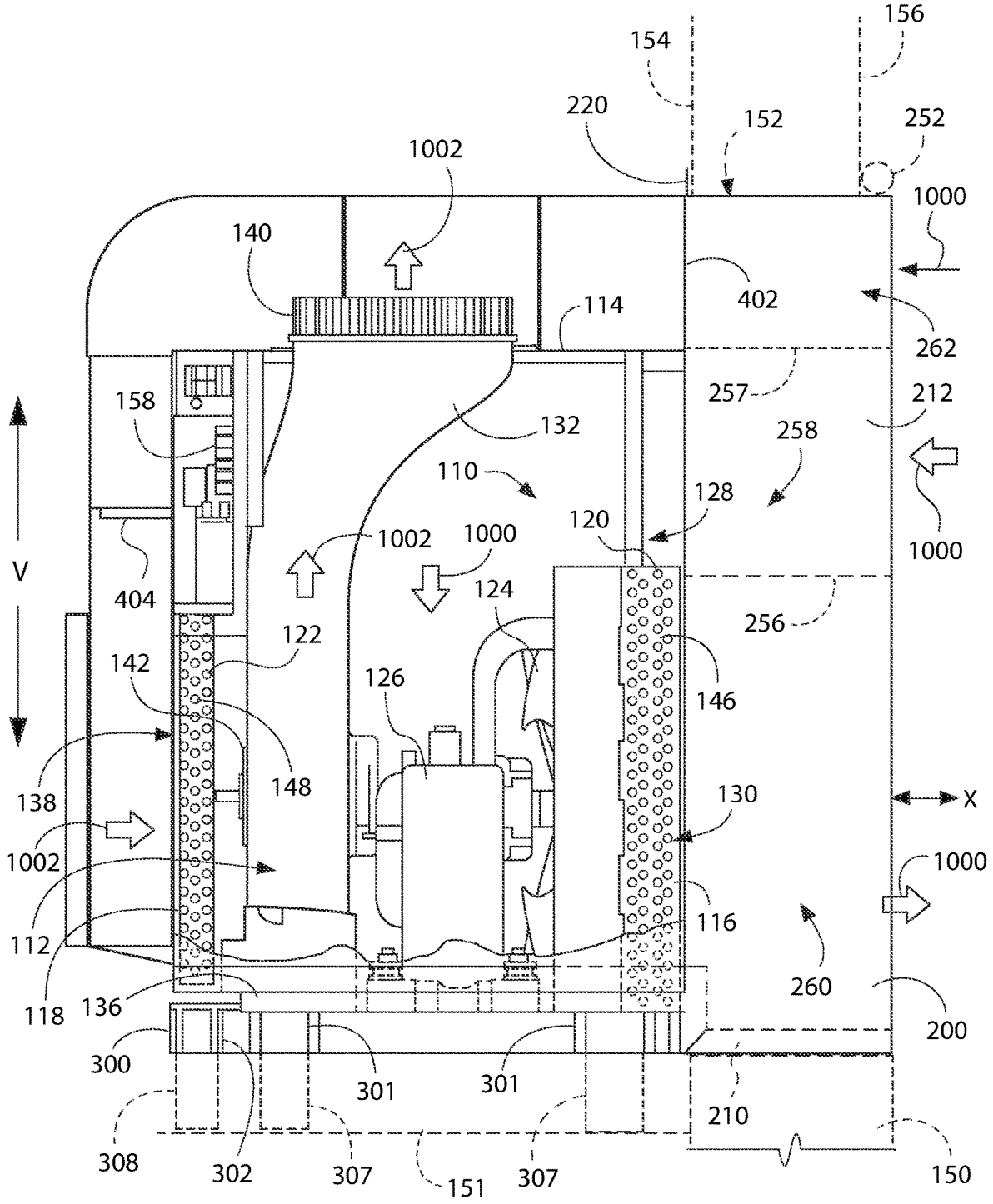
FIG. 2 provides a section view of the air conditioner unit of FIG. 1 according to one or more exemplary embodiments of the present disclosure.

Turning now to the figures, FIGS. 1 and 2 illustrate an exemplary air conditioner appliance or air conditioner unit (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V, L, T is mutually perpendicular with every other direction, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 may be part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components are mounted on a base 136, as shown. The base 136 may be received on or within a drain pan 300.

During certain operations, air 1000 may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 112 may include an indoor heat exchanger 122, and an indoor fan 142, e.g., a blower fan 142 as in the illustrated example embodiment. These components may, for example, be housed behind the front opening 118. A bulkhead may generally support or house various other components or portions thereof of the indoor portion 112, such as the blower fan 142. The bulkhead may generally separate and define the indoor portion 112 and outdoor portion 110 within housing 114.

During certain operations, air 1002 may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 before passing to a duct 132. The indoor air 1002 may be motivated (e.g., by fan 142) into and through the duct 132 and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air 1002 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchangers 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated to perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base 136) and an expansion device (e.g., expansion valve or capillary tube—not pictured), both of which may be in fluid communication with the heat exchangers 120, 122 to flow refrigerant therethrough, as is generally understood. The outdoor and indoor heat exchangers 120, 122 may each include coils 146, 148, as illustrated, through which a refrigerant may flow for heat exchange purposes, as is generally understood.

A plenum 200 may be provided to direct air to or from housing 114. When installed, plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed) and above a floor 151. In particular, plenum 200 extends along an axial direction X (e.g., parallel to the transverse direction T) through a hole or channel 152 in the structure wall 150 that passes from an internal surface 154 to an external surface 156. Optionally, a caulk bead 252 (i.e., adhesive or sealant caulk) may be provided to join the plenum 200 to the external surface 156 of structure wall 150 (e.g., about or outside from wall channel 152).

The plenum 200 includes a duct wall 212 that is formed about the axial direction X (e.g., when mounted through wall channel 152). Duct wall 212 may be formed according to any suitable hollow shape, such as conduit having a rectangular profile (shown), defining an air channel 210 to guide air therethrough. Moreover, duct wall 212 may be formed from any suitable non-permeable material (e.g., steel, aluminum, or a suitable polymer) for directing or guiding air therethrough. In certain embodiments, plenum 200 further includes an outer flange 220 that extends in a radial direction (e.g., perpendicular to the axial direction X) from duct wall 212. Specifically, outer flange 220 may extend radially outward (e.g., away from at least a portion of the axial direction X or the duct wall 212).

In some embodiments, plenum 200 includes a divider wall 256 within air channel 210. When assembled, divider wall 256 defines a separate upper passage 258 and lower passage 260. For instance, divider wall 256 may extend along the lateral direction L from one lateral side of plenum 200 to the other lateral side. Generally, upper passage 258 and lower passage 260 may divide or define two discrete air flow paths for air channel 210. When assembled, upper passage 258 and lower passage 260 may be fluidly isolated by divider wall 256 (e.g., such that air is prevented from passing directly between passages 258 and 260 through divider wall 256, or another portion of plenum 200). Upper passage 258 may be positioned upstream from outdoor inlet 128. Lower passage 260 may be positioned downstream from outdoor outlet 130.

The plenum 200 may further include a second divider wall 257 which separates a make-up air passage 262 from the remainder of the air channel 210, such as from the upper passage 258 and the lower passage 260. For example, the make-up air passage 262 may be positioned directly above the upper passage 258, whereby the second divider separates and partially defines the make-up air passage 262 and the upper passage 258, e.g., as in the exemplary embodiment illustrated in FIG. 2. Similar to the divider wall 256 described above, the second divider wall 257 may extend along the lateral direction L from one lateral side of plenum 200 to the other lateral side. The make-up air passage 262 may thereby define a discrete air flow path within air channel 210 which is separate and distinct from the upper and lower passages 258 and 260. When assembled, the make-up air passage 262 may be fluidly isolated by the second divider wall 257 from one or both of the upper passage 258 and lower passage 260, e.g., such that air is prevented from passing directly between the make-up air passage 262 and the upper and lower passages 258 and 260 through the second divider wall 257, or any other portion of plenum 200). The make-up air passage 262 may be positioned upstream from a make-up air duct 400. In some embodiments, outdoor air 1000 may be drawn into the make-up air duct 400 by a make-up air fan, e.g., a muffin fan, via the make-up air passage 262. The make-up air duct 400 may extend from a first end 402 at the make-up air passage 262 of the plenum 200 to a second end 404 at the indoor portion 112 of the housing 114, e.g., upstream of the indoor inlet 138, whereby outdoor air, e.g., make-up air, may be provided directly to the indoor portion 112 of the air conditioner 100 via the make-up air duct 400. Thus, the make-up air duct 400 may be a component of a make-up air system or make-up air assembly.

The operation of air conditioner 100 including compressor 126 (and thus the sealed system generally), indoor fan 142, outdoor fan 124, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 158 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Further, it should be understood that controllers 158 as disclosed herein are capable of and may be operable to perform any methods and associated method steps as disclosed herein.

Air conditioner 100 may additionally include a control panel 160 (FIG. 1) and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Also as may be seen in FIG. 2, in some instances when the plenum 200 is installed within the wall 150 above the floor 151, the remainder of the air conditioner unit 100 may be suspended or cantilevered from the plenum 200. In order to avoid such cantilever, one or more support legs 307 and/or 308 may be provided between the drain pan 300 and the floor 151, whereby at least some of the weight of the remaining components of the air conditioner unit 100 is shifted off of the plenum 200. Where the installation height of the plenum 200 above the floor 151 varies, the required height of the leg(s) 307 and/or 308 will also vary. Thus, the leg(s) 307 and/or 308 may be cut in the field and custom-fitted to the specific installation.

The drain pan 300 may include one or more sockets which are configured to receive the leg(s) 307 and/or 308. For example, as illustrated in FIG. 2, the drain pan 300 may include a first socket 301 and a second socket 302. As illustrated in FIG. 2, the socket(s) 301 and/or 302 may be positioned opposite the plenum 200 along the transverse direction T. For example, the plenum 200 may be positioned at a first transverse end of the drain pan 300 and the socket(s) 301/302 may be positioned opposite the plenum 200 at or near a second transverse end of the drain pan 300. Also as may be seen in FIG. 2, in some embodiments the drain pan 300 may also or instead include one or more of the sockets 301 and/or 302 at the other end of the pan 300, e.g., proximate the plenum 200. In various embodiments, one or both of the sockets 301 and 302 may be provided. In some embodiments, each socket 301 and 302 may be one of a pair of matching shaped sockets which are spaced apart along the lateral direction L and aligned along the transverse direction T.

The material for the leg(s) 307 and/or 308 may be any suitable material which is strong enough to bear the weight of the housing 114 and drain pan 300. For example, materials which are likely to be readily available during installation of the air conditioner unit and which can be suitable for forming the leg(s) 307 and/or 308 include building materials such as lumber, e.g., dimensional lumber such as a nominal two-inch-by-four-inch board, commonly referred to as a two-by-four, or plumbing, e.g., PVC piping having sufficient size (e.g., outer diameter, wall thickness, etc.). Thus, in some embodiments, the socket, e.g., first socket 301, may have a rectangular cross-section and may thereby be configured to receive a leg 307 made of lumber, such as a two-by-four leg, a two-by-six leg, or a four-by-four leg, etc. Additionally, in some embodiments, the socket, e.g., the second socket 302, may be cylindrical and may thereby be configured to receive a round, e.g., cylindrical, leg 308, such as a piece of piping, e.g., a PVC pipe as mentioned above, or, as another example, a steel pipe or other tubular or solid round leg 308.

Figure 3:
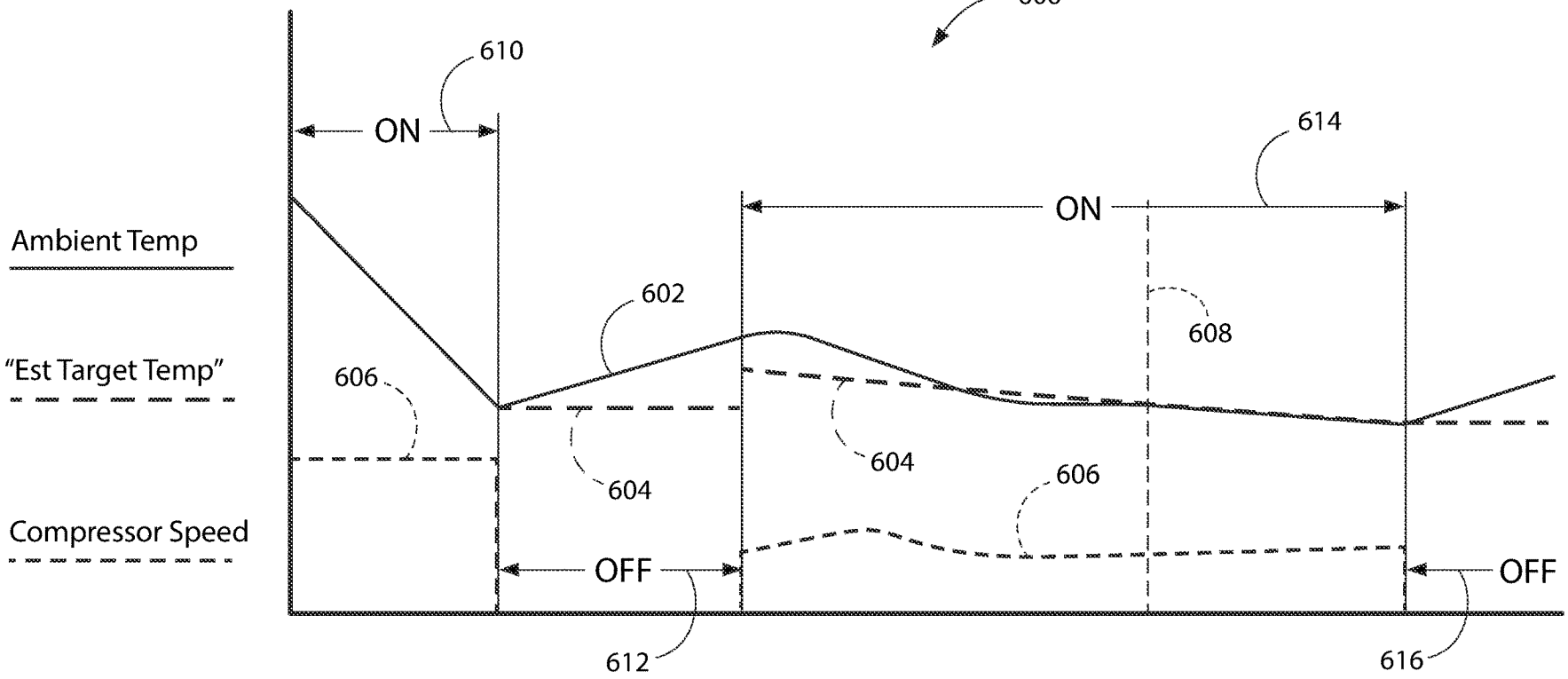
FIG. 3 provides a graph of measured ambient temperature, estimated setpoint temperature, and compressor speed over time in an exemplary operation of an air conditioner unit according to one or more embodiments of the present disclosure.

Turning now to FIG. 3, an exemplary graph 600 of measured ambient temperature 602, estimated setpoint temperature 604, and compressor speed 606 over time in an exemplary operation of an air conditioner unit according to various embodiments of the present disclosure is illustrated. Those of ordinary skill in the art will recognize that the exemplary operation illustrated in FIG. 3 is a cooling operation, e.g., wherein the ambient temperature decreases when the air conditioner unit, such as the compressor thereof, is activated. The cooling operation is illustrated by way of example only, embodiments of the present disclosure may also be used with heating mode (e.g., heat pump mode) operation of an air conditioner unit as well as or instead of the illustrated cooling operation in FIG. 3. The exemplary operation illustrated in FIG. 3 takes place over a period of time and includes multiple ON cycles, during which the compressor, e.g., compressor 126 (FIG. 2) is operating at a greater than zero speed, and multiple OFF cycles, during which the compressor is not operating. It should be understood that the period of time covered by the graph in FIG. 3 is just an exemplary portion of the air conditioners operation, e.g., that additional ON and OFF cycles may further be carried out as part of the air conditioner operation after the period of time covered in FIG. 3.

The exemplary operation illustrated in FIG. 3 corresponds to an air conditioner unit having a true variable speed compressor, e.g., that is operable over an entire range of speeds including all intermediate speeds between the minimum and maximum of the range, rather than, e.g., just at a high speed and a low speed or other set of discrete speeds.

As may be seen in FIG. 3, the ambient temperature 602 may be monitored throughout the operation of the air conditioner unit. Also as illustrated in FIG. 3, the compressor may be operated at a fixed speed during an initial ON cycle 610 of the air conditioner unit operation. At the end of the ON cycle 610, e.g., when the thermostat discontinues the call for cooling or heating, the current value of the ambient temperature may be stored as the estimated setpoint temperature (labeled as "Estimated Target Temperature" and illustrated by dashed line 606 in FIG. 3 and 706 in FIG. 4). For example, the thermostat may discontinue the call for cooling or heating when the ambient temperature (as measured by the thermostat, e.g., at the thermostat) reaches the target temperature or setpoint temperature. Thus, the ambient temperature 602 (as measured by the air conditioner unit, e.g., with a temperature sensor such as a thermistor in the indoor portion of the air conditioner unit) at the time the thermostat discontinues the call for cooling or heating may be used as an initial estimate of the target temperature or setpoint temperature, e.g., as illustrated in FIG. 3, where line 604 begins at the end of ON cycle 610, e.g., at the intersection of ambient temperature 602 and the vertical line representing the end of the first ON cycle 610.

After establishing the initial estimate of the setpoint temperature (e.g., the leftmost end of line 604 in FIG. 3) at the end of the first ON cycle 610, the estimated setpoint temperature 604 may be fixed during the subsequent OFF cycle 612, until the thermostat again calls for cooling or heating and thereby initiates an ON cycle of the compressor, such as the second or subsequent ON cycle 614 illustrated in FIG. 3.

Still referring to FIG. 3, the estimated setpoint temperature 604 may then be shifted or offset, such as upwards, e.g., increased in a cooling operation such as the exemplary cooling operation illustrated in FIG. 3, or decreased in a heating operation, at the beginning of the next ON cycle 614, e.g., at the intersection of line 604 and the first vertical boundary line of ON cycle 614 as illustrated in FIG. 3. For example, the shift may be by about 1° F., such as between about 0.5° F. and about 5° F., such as between about 1° F. and about 3° F. During the next, e.g., second, ON cycle 614, the estimated setpoint temperature may have a slope, such as a linear decrease, e.g., during a cooling operation, or a linear increase, e.g., during a heating operation. For example, the estimated setpoint temperature may be decreased, such as decreased at a constant, linear rate over the entirety of the ON cycle, e.g., as indicated by the slope of line 604 across the span of ON cycle 614 in FIG. 3. For example, the decrease may be about 0.1° F. per minute, or about 0.1° F. every four minutes, etc., throughout the ON cycle. Thus, in various exemplary embodiments, the rate of decrease may be 0.1° F. per unit of time, and the unit of time may be between about 30 seconds and about 10 minutes, such as between about 1 minute and about 5 minutes, such as between about 2 minutes and about four minutes, such as about one minute, such as about two minutes, such as about three minutes, and/or about four minutes. Additionally, in a heating operation, the estimated setpoint temperature may be increased, such as increased at a constant, linear rate over the entirety of the ON cycle, e.g., with the inverse slope of line 604 across the span of ON cycle 614 illustrated in FIG. 3, and/or at any of the rates described above, e.g., increasing by 0.1° F. per unit of time.

The ON cycle also includes operating the variable speed compressor at one or more non-zero (greater than zero) speeds. For example, the variable speed compressor may be operated at varying speeds based on the ambient temperature and the estimated setpoint temperature, e.g., as shown by the gradual curvature in line 606 over at least a first portion of the second ON cycle 614. For example, the compressor speed 606 may be controlled by a closed-loop control algorithm during the subsequent ON cycle 614, where the ambient temperature 602 (measured by the air conditioner unit, as mentioned above) and the estimated setpoint temperature 604 are the inputs into the algorithm, and the algorithm outputs compressor speed values, e.g., which may be or correspond to the speed 606 at which the compressor is then operated when the variable speed compressor is operated according to the closed-loop algorithm. Any suitable closed-loop control algorithm may be used, e.g., a proportional-integral (PI) control, a proportional-integral-derivative (PID) control, or other similar closed-loop feedback based control may be used in various embodiments of the present disclosure. Those of ordinary skill in the art will recognize that such controls, e.g., PI controls, may overshoot the target value as the error values are reduced. Thus, the initial shift of the estimated setpoint temperature 604 at the start of the ON cycle 614 may reduce or prevent prematurely turning off the compressor when the closed-loop control algorithm, e.g., PI control, overshoots the target temperature, e.g., when the ambient temperature 602 dips below (in cooling operations, or above if in a heating operation) the estimated setpoint temperature 604.

The vertical dashed line 608 in FIG. 3 represents the point in time at which the compressor would be expected to turn off based on the closed-loop control, e.g., where the ambient temperature 602 is equal to (e.g., intersects in the graph 600 illustrated in FIG. 3) the estimated setpoint temperature 604. The x-axis coordinate or horizontal position of the vertical line 608 represents a theoretical or expected cycle time based on the offset divided by the slope, e.g., with a shift of 1° F. and a slope of 0.1° F. per minute, the expected cycle time would be ten minutes. Beyond that point, e.g., when the thermostat is still calling for cooling (or heating in other exemplary operations) after the ambient temperature 602 and the estimated setpoint temperature 604 are equal and remain steady, such as to the right of line 608 in FIG. 3, the compressor may operate at a fixed speed until the thermostat discontinues the call for cooling, e.g., at the right boundary of ON cycle 614 as illustrated in FIG. 3. As with the end of the first ON cycle 610, the estimated setpoint temperature 604 is then updated to the measured ambient temperature 602 when the thermostat is satisfied, e.g., when the thermostat stops calling for cooling (or heating, in other exemplary embodiments). Following the subsequent ON cycle 614 is another OFF cycle 616, during which the estimated setpoint temperature 604 may remain fixed, as described above with respect to the first OFF cycle 612. As mentioned above, the graph 600 illustrates only an exemplary portion of an air conditioner unit operation, e.g., another ON cycle may follow after the OFF cycle 616, etc.

Figure 4:
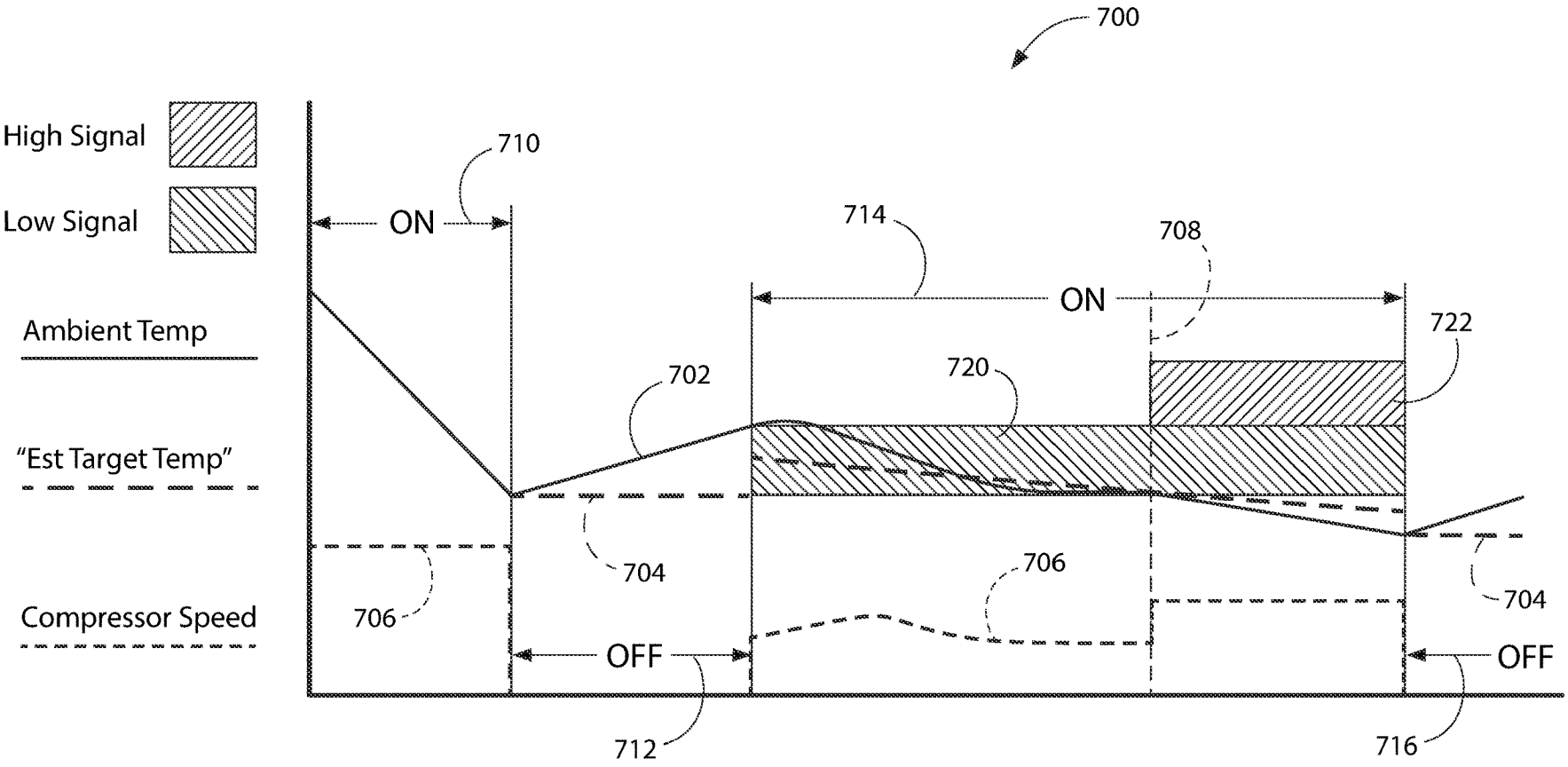
FIG. 4 provides another graph of measured ambient temperature, estimated setpoint temperature, and compressor speed over time in an exemplary operation of an air conditioner unit according to one or more additional embodiments of the present disclosure.

FIG. 4 provides another graph 700 of an exemplary cooling operation of an air conditioner unit. Similar to FIG. 3 as mentioned above, the graph 700 in FIG. 4 is by way of example only, and other exemplary operations, e.g., heating operations may also be provided. For example, the graph 700 of FIG. 4 may be inverted for a heating operation.

Similar to FIG. 3 as described above, the exemplary graph 700 in FIG. 4 includes an initial ON cycle 710 during which the compressor is operated at a fixed speed, and the estimated target temperature or estimated setpoint temperature 704 is initially set to the measured ambient temperature 702 at the end of the first ON cycle 710. FIG. 4 also includes an OFF cycle 712, a second ON cycle 714 (during which the compressor speed 706 is controlled based on the measured ambient temperature 702 and the estimated setpoint temperature 704, e.g., in a closed-loop algorithm as described above), and a second OFF cycle 716.

Further, FIG. 4 also illustrates control signals from the thermostat received by the air conditioner unit. In particular, the control signals may include a low signal 720, e.g., a low speed signal, from the thermostat and a high speed signal 722 from the thermostat.

In particular, FIG. 4 illustrates an exemplary air conditioner unit operation wherein the actual target temperature or setpoint temperature is changed, e.g., reduced (or increased in an exemplary heating operation) during the ON cycle 714. When the setpoint is reduced at the thermostat, the thermostat then calls for increased cooling, e.g., increased compressor speed as represented by the high signal 722 in FIG. 4, due to the increased difference between the ambient temperature (as measured by and at the thermostat) and the actual setpoint (e.g., as received by the thermostat from a user input on or connected to the thermostat). Thus, as indicated by vertical line 708 in FIG. 4, the thermostat may call for increased cooling, e.g., may transmit a high signal 722 to the air conditioner unit. In such instances, the previously estimated setpoint temperature 704 may be less accurate due to the change in the actual setpoint temperature, and the air conditioner unit may thus operate the compressor at a fixed speed (indicated by the flat portion of line 706 to the right of 708 in FIG. 4) when the call for cooling (or heating) includes a high speed signal 722 from the thermostat, and the fixed speed in such instances may be higher than the variable speed at which the compressor was operating just prior to the call for increased cooling (e.g., high signal 722). In additional embodiments, the air conditioner unit may operate the compressor at a variable speed within a constrained range, e.g., above an elevated minimum speed, when the call for cooling (or heating) includes a high speed signal 722 from the thermostat. For example, the compressor speed illustrated in FIG. 4 that coincides with the high signal 722, e.g., the portion of line 706 in FIG. 4 that is horizontally coextensive with the high signal 722, may be the elevated minimum speed. Also as may be seen in the portion of graph 700 to the right of line 708 in FIG. 4, whenever the ambient temperature 702 is less than (in cooling operation, or above in heating operation) the estimated target temperature 704, e.g., because the actual setpoint temperature was lowered (or raised, in a heating operation) at the thermostat such that the call for cooling (or heating) continues beyond (e.g., below in cooling operating or above in heating operation) the estimated setpoint temperature, the compressor may be operated at a fixed speed, e.g., the closed-loop control may be disabled. In some exemplary embodiments, the compressor may go to fixed speed, or may operate in a constrained speed range constrained by the elevated minimum speed, whenever the high signal 722 is received, e.g., based on and in response to the high signal 722.

Figure 5:
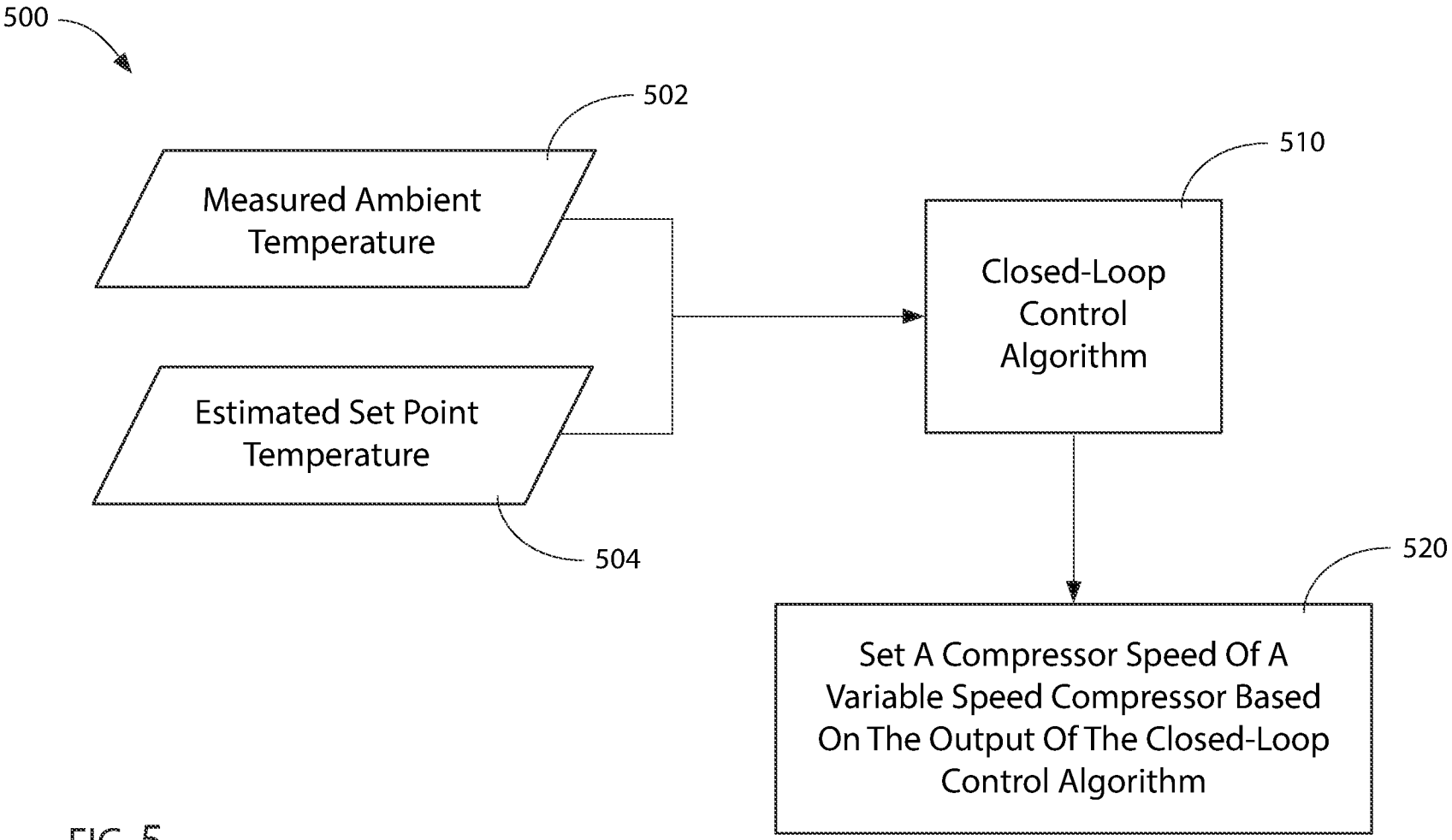
FIG. 5 provides a flowchart illustrating an example method of operating an air conditioner unit according to one or more example embodiments of the present disclosure.

Turning now to FIG. 5, embodiments of the present disclosure also include methods of operating an air conditioner unit such as method 500 illustrated in FIG. 5, where the air conditioner unit may be, e.g., the air conditioner unit 100 illustrated in FIGS. 1 and 2 and described above.

As illustrated in FIG. 5, the method 500 may include a closed-loop control algorithm 510, which receives input data 502 and 504, e.g., a measured ambient temperature 502, such as an ambient temperature measured at a temperature sensor in the indoor portion of the air conditioner unit, and an estimated setpoint temperature 504.

In some embodiments, the estimated setpoint temperature may be estimated after, such as at the end of, a first or initial ON cycle of the air conditioner unit. For example, the method 500 may include activating the variable speed compressor at a fixed speed over a first ON cycle prior to estimating the setpoint temperature. In such embodiments, the compressor speed may be set based on the output of the closed-loop algorithm in a next ON cycle after the first ON cycle. Further, such embodiments may also include measuring the ambient temperature at an end of the first ON cycle and storing the measured ambient temperature at the end of the first ON cycle as the estimated setpoint temperature.

Also as illustrated in FIG. 5, the method 500 may further include a step 520 of setting a compressor speed of a variable speed compressor of the air conditioner unit based on the output of the closed-loop control algorithm. For example, the closed-loop control may be any suitable closed-loop algorithm, such as a proportional-integral (PI) control. In some embodiments, as mentioned above, the step 520 may be performed during a second and/or other subsequent ON cycle of the air conditioner unit after an initial or first ON cycle of the air conditioner unit.

In some embodiments, the method 500 may also include changing, e.g., reducing during a cooling operation and/or increasing during a heating operation, the estimated setpoint temperature over an ON cycle after the first ON cycle, such as a second or other subsequent ON cycle, e.g., where the estimated setpoint is established after or at the end of the first ON cycle. For example, the method 500 may include changing, e.g., reducing and/or increasing, the estimated setpoint at a predetermined rate over the ON cycle, such as a constant, linear rate.

In some embodiments, the method 500 may include shifting, e.g., increasing during a cooling operation and/or reducing during a heating operation, the estimated setpoint temperature at a start of the next ON cycle after the first ON cycle. As described above with reference to FIG. 3, such shift may accommodate an expected overshoot in the output from the closed-loop, e.g., PI, control algorithm.

As described above in reference to FIG. 4, in some embodiments, e.g., when the actual setpoint changes during the operation of the air conditioner unit, the method 500 may include setting the compressor speed of the variable speed compressor to a fixed speed when the measured ambient temperature overshoots, e.g., is less than in cooling operation or greater than in heating operation, the estimated setpoint temperature. Some embodiments of method 500 may also include receiving a high speed signal from a thermostat and setting the compressor speed of the variable speed compressor to an elevated speed in response to the high speed signal, e.g., also as discussed above with reference to FIG. 4. For example, the variable speed compressor may be set to an elevated minimum speed in response to the high speed signal, whereby the variable speed compressor may be operable within a constrained speed range, such as a speed range from and including the elevated minimum speed up to and including a maximum speed of the variable speed, where the constrained speed range also includes all intermediate speeds, e.g., the variable speed compressor is still a true variable speed compressor, as described above, over the constrained speed range.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an air conditioner unit, the air conditioner unit comprising a housing defining an outdoor portion and an indoor portion, an outdoor heat exchanger disposed in the outdoor portion, an indoor heat exchanger disposed in the indoor portion, and a variable speed compressor in fluid communication with the outdoor heat exchanger and the indoor heat exchanger to circulate a refrigerant between the outdoor heat exchanger and the indoor heat exchanger, wherein the variable speed compressor is a true variable speed compressor operable over a range of speeds including all intermediate speeds between a minimum and a maximum of the range, the method comprising:

measuring an ambient temperature;

estimating a setpoint temperature of the air conditioner unit;

inputting the measured ambient temperature and the estimated setpoint temperature into one of a proportional-integral control algorithm or a proportional-integral-derivative control algorithm;

setting a compressor speed of the variable speed compressor based on the output of the one of the proportional-integral control algorithm or the proportional-integral-derivative control algorithm; and activating the variable speed compressor at a fixed speed over a first ON cycle prior to estimating the setpoint temperature, wherein the compressor speed is set based on the output of the one of the proportional-integral control algorithm or the proportional-integral-derivative control algorithm in a next ON cycle after the first ON cycle, wherein estimating the setpoint temperature comprises measuring the ambient temperature at an end of the first ON cycle and storing the measured ambient temperature at the end of the first ON cycle as the estimated setpoint temperature.

2. The method of claim 1, further comprising reducing the estimated setpoint temperature over a next ON cycle after the first ON cycle.

3. The method of claim 1, further comprising increasing the estimated setpoint temperature over a next ON cycle after the first ON cycle.

4. The method of claim 1, further comprising increasing the estimated setpoint temperature at a start of a next ON cycle after the first ON cycle.

5. The method of claim 1, further comprising reducing the estimated setpoint temperature at a start of a next ON cycle after the first ON cycle.

6. The method of claim 1, further comprising setting the compressor speed of the variable speed compressor to a fixed speed when the measured ambient temperature is less than the estimated setpoint temperature.

7. The method of claim 1, further comprising receiving a high speed signal from a thermostat and setting the compressor speed of the variable speed compressor to an elevated minimum speed in response to the high speed signal.

8. An air conditioner unit, comprising:

a housing defining an outdoor portion and an indoor portion;

an outdoor heat exchanger disposed in the outdoor portion;

an indoor heat exchanger disposed in the indoor portion;

a variable speed compressor in fluid communication with the outdoor heat exchanger and the indoor heat exchanger to circulate a refrigerant between the outdoor heat exchanger and the indoor heat exchanger, wherein the variable speed compressor is a true variable speed compressor operable over a range of speeds including all intermediate speeds between a minimum and a maximum of the range; and a controller, the controller configured for:

measuring an ambient temperature;

estimating a setpoint temperature of the air conditioner unit;

inputting the measured ambient temperature and the estimated setpoint temperature into one of a proportional-integral control algorithm or a proportional-integral-derivative control algorithm;

setting a compressor speed of the variable speed compressor based on the output of the one of the proportional-integral control algorithm or the proportional-integral-derivative control algorithm, and activating the variable speed compressor at a fixed speed over a first ON cycle prior to estimating the setpoint temperature, wherein the compressor speed is set based on the output of the one of the proportional-integral control algorithm or control algorithm or the proportional-integral-derivative control algorithm in a next ON cycle after the first ON cycle, wherein estimating the setpoint temperature comprises measuring the ambient temperature at an end of the first ON cycle and storing the measured ambient temperature at the end of the first ON cycle as the estimated setpoint temperature.

9. The air conditioner unit of claim 8, wherein the controller is further configured for reducing the estimated setpoint temperature over a next ON cycle after the first ON cycle.

10. The air conditioner unit of claim 8, wherein the controller is further configured for increasing the estimated setpoint temperature over a next ON cycle after the first ON cycle.

11. The air conditioner unit of claim 8, wherein the controller is further configured for increasing the estimated setpoint temperature at a start of a next ON cycle after the first ON cycle.

12. The air conditioner unit of claim 8, wherein the controller is further configured for decreasing the estimated setpoint temperature at a start of a next ON cycle after the first ON cycle.

13. The air conditioner unit of claim 8, wherein the controller is further configured for setting the compressor speed of the variable speed compressor to a fixed speed when the measured ambient temperature is less than the estimated setpoint temperature.

14. The air conditioner unit of claim 8, wherein the controller is further configured for receiving a high speed signal from a thermostat and setting the compressor speed of the variable speed compressor to an elevated minimum speed in response to the high speed signal.

* * * * *